United States Patent [19]

Sluse et al.

[11] 4,110,181

[45] Aug. 29, 1978

[54] METHOD OF HANDLING AQUEOUS SOLUTIONS OF ALKALI METAL HYDROXIDES THAT ARE CONCENTRATED IN RESPECT OF ALKALI METAL HALIDES

[75] Inventors: Guy Sluse, Rixensart; Francois Dujardin, Brussels, both of Belgium

[73] Assignee: Solvay & Cie, Belgium

[21] Appl. No.: 727,011

[22] Filed: Sep. 27, 1976

[30] Foreign Application Priority Data

Oct. 8, 1975 [FR] France ..... 75 31214

[51] Int. Cl.[2] ..... C23F 13/00

[52] U.S. Cl. ..... 204/147; 204/98; 204/196

[58] Field of Search ..... 204/147, 196, 98

[56] References Cited

U.S. PATENT DOCUMENTS

| | | | |
|---|---|---|---|
| 2,366,796 | 1/1945 | Lawrence et al. | 204/147 |
| 2,681,884 | 6/1954 | Butler | 204/98 |
| 2,954,333 | 9/1960 | Heiskell et al. | 204/98 |
| 3,009,865 | 11/1961 | Mueller et al. | 204/147 |
| 3,242,059 | 3/1966 | Cottam et al. | 204/98 |
| 3,250,691 | 5/1966 | Broun et al. | 204/98 |
| 3,375,183 | 3/1968 | Banks et al. | 204/196 |
| 3,409,526 | 11/1968 | Banks et al. | 204/147 |

FOREIGN PATENT DOCUMENTS

| | | | |
|---|---|---|---|
| 136,148 | 12/1959 | U.S.S.R. | 204/147 |

OTHER PUBLICATIONS

"Werkstoffe und Korrosion," vol. 22, No. 1, 1971, pp. 16–31.

Reprint from "Corrosion" vol. 16, No. 2, Feb. 1960, pp. 47t–54t.

*Primary Examiner*—T. Tung

*Attorney, Agent, or Firm*—Robert E. Burns; Emmanuel J. Lobato; Bruce L. Adams

[57] ABSTRACT

A method is disclosed for handling corrosive concentrated aqueous solutions of alkali metal hydroxides containing major amounts of alkali metal halides in equipment made of ordinary or mild steel. Corrosion is prevented by a combination of controlling the amount of alkali metal hydroxide to less than 500 gms per kilogram of solution; maintaining the temperature of the solution below 130° C; and providing an anodic potential of between −1000 mV and −200 mV with respect to the potential of the saturated calomel electrode.

5 Claims, No Drawings

METHOD OF HANDLING AQUEOUS SOLUTIONS OF ALKALI METAL HYDROXIDES THAT ARE CONCENTRATED IN RESPECT OF ALKALI METAL HALIDES

FIELD OF THE INVENTION

The present invention relates to a method of handling, in metallic equipment, aqueous solutions of alkali metal hydroxides that are highly concentrated in respect of alkali metal halides, particularly alkaline liquors produced by the electrolysis of aqueous solutions of sodium chloride or potassium chloride in diaphragm cells.

BACKGROUND OF THE INVENTION

The alkaline liquors produced by the electrolysis of concentrated sodium chloride brines in diaphragm cells generally contain between 9 and 13% by weight of sodium hydroxide and between 14 and 17% by weight of sodium chloride. As they leave the electrolytic cells, these hot alkaline liquors are usually transferred by way of metallic conduits to storage vessels and/or evaporators where they are concentrated in respect of sodium hydroxide while precipitating sodium chloride.

In view of the highy corrosive character of hot alkaline-liquors of high sodium chloride content, and particularly of liquors saturated or supersaturated with sodium chloride, that are treated in the evaporators, these evaporators are generally made of corrosion-resistant metals or alloys, for example of nickel or stainless steel.

The use of corrosion-resistant metals or alloys severely burdens the cost of equipment handling alkaline liquors.

Even when made of metals or alloys of high quality, the evaporators corrode progressively nevertheless during use.

It has been proposed, in the publication "Werkstoffe und Korrosion", 22nd year, first installment, 1971, p. 22, to retard the corrosion of 18/8 steel in contact with aqueous solutions containing halides, by maintaining the steel at an anodic potential in order to passivate it and by incorporating a corrosion inhibitor in the solutions treated, for example sulphate or nitrate ions. This solution nevertheless further burdens both the cost of the plants and the operating expenses.

It has also been proposed, on pages 23–29 of the aforesaid publication, to treat sodium aluminate liquors devoid of halides in evaporators made of ordinary steel, anodically polarised.

It has however been thought, until now, that equipments made of ordinary steel would not be suitable for treating hot alkaline liquors, containing halides it has particularly been thought, until now, that it was impossible to use evaporators made of ordinary steel for concentrating alkaline liquors substantially saturated or supersaturated with sodium chloride and resulting from the electrolysis of brines in diaphragm cells.

THE INVENTION

The applicant has now found conditions which allow the use of equipment made of ordinary steel, in particular evaporators, for the treatment of alkaline liquors that are highly concentrated, even saturated or supersaturated with alkali metal halide.

DETAILED DESCRIPTION

The invention relates therefore to a method of handling hot aqueous solutions of alkali metal hydroxides that are concentrated in respect of alkali metal halides, in metallic equipment, wherein the equipment is made of ordinary steel, the concentration of the solution is controlled so that it contains less than 500g of alkali metal hydroxide per kg, the temperature of the solution is maintained below 130° C and the equipment is maintained at an anodic potential of substantially between −1,000 mV and −200 mV with respect to the potential of the saturated calomel electrode.

By ordinary steel is meant an iron-carbon alloy the carbon content of which is less than 1.7% by weight and in which any other elements are present in traces or in amounts insufficient to exert a perceptible influence on the properties of the alloy. These elements comprise more particularly the usual impurities of steel (Si, S, Mn, P, O, N, H, etc.), as well as minor elements arising from the raw materials used in the production of the steel (Al, Ni, Cr, Cu, Sn, etc.).

In the account which follows, the potentials are expressed relative to the potential of the saturated calomel electrode.

The method according to the invention allows the corrosion of installations made of ordinary steel, in contact with hot alkaline liquors concentrated in respect of halide, for example chloride, to be reduced to a very low level.

The invention thus provides the appreciable advantage of allowing the use of a common and cheap alloy for the construction of installations for handling alkaline liquors containing halides. The invention finds for example an application in the handling of such liquors in piping systems, storage vessels or heat exchangers made of metal. Very specially it allows the cost to be reduced to a great extent of the evaporators used for concentrating the alkaline liquors containing sodium chloride, obtained by electrolysis of brine in diaphragm cells.

In the method according to the invention, it is preferable that the anodic potential of the installation does not exceed −200 mV, so as to maintain the protective film of oxide formed by passivation on the walls of the installation. It is however desirable to avoid having the anodic potential less than −1,000 mV, so as to avoid cracking of the steel by associated corrosion and stresses sometimes referred to as "Caustic embrittlement".

In one particular manner of carrying out the method according to the invention, applied to the case of a solution containing at least 300g of alkali metal hydroxide per kg of solution, the temperature of the solution is held below 120° C, preferably between 60° and 120° C, and the anodic potential of the installation made of ordinary steel is maintained between −1,000 and −500 mV, preferably between −950 and −700 mV.

In the case of a solution containing at least 400g of alkali metal hydroxide per kg of solution, it is advantageous to maintain the temperature of the solution below 90° C, preferably around 60° C, and to maintain the anodic potential of the installation made of ordinary steel between −900 and −700 mV, preferably at −800 mV.

The following examples of use will illustrate the invention, without however limiting its scope In each of these examples, a cylindrical bar of extra mild steel (carbon content: 0.054%) was immersed in an alkaline liquor saturated with sodium chloride, and the corrosion suffered by the bar was observed at different temperatures of operation and different sodium hydroxide concentrations in the liquor.

The tests were carried out under an atmosphere of nitrogen. Each test lasted about 4 days. So as to make the tests comparative, the same grade of steel was used for all the bars submitted to the corrosion tests.

The bars had a section of 7 mm diameter. They were placed in contact with the alkaline liquor to a depth of 75 mm demarcated between their lower end and an envelope of polytetrafluoroethylene surrounding their upper portion. The total surface of each bar in contact with the alkaline liquor was thus of the order of 17 $cm^2$.

Before the tests, the bars were successively degreased in trichloroethylene, rinsed in water, pickled in a 3N solution of hydrochloric acid containing a corrosion inhibitor, rinsed in water and dried in acetone.

In order to evaluate the resistance of the bars to corrosion by the liquors, each bar was weighed before and after the corrosion test, so as to ascertain the loss in weight suffered during the test. After the test the bar was also submitted to cleaning in the pickling solution described above, then weighed a second time to determine the amount of oxide film formed on its surface.

In the following examples, the eight losses of the bars are expressed as $g/m^2$ of bar surface and per day.

FIRST SERIES OF TESTS (COMPARATIVE TESTS)

These tests were carried out on bars of extra mild steel immersed in an alkaline liquor saturated with sodium chloride, with no protection of the bars whatever against corrosion.

EXAMPLE 1

A bar of extra mild steel was immersed in an alkaline liquor containing 400g of sodium hydroxide per kg and heated to 60° C. At the end of the test there was recorded for the bar, a loss in weight corresponding to 1.5 g per $m^2$ and per day. After pickling, the loss in weight had increased to 1.6 $g/m^2$ per day.

EXAMPLE 2

The alkaline liquor employed contained, per kg, 300g of sodium hydroxide. It was heated to 60° C and a bar was immersed in it. The bar suffered, during the test, a loss in weight by corrosion of 2.2 $g/m^2$ per day. After pickling, the loss in weight of the bar had increased to 3.2 $g/m^2$ per day.

EXAMPLE 3

The test of Example 2 was repeated, but this time with the temperature raised to 90° C. The loss in weight of the bar increased to 9.2 $g/m^2$ per day before pickling and 10 $g/m^2$ day after pickling.

EXAMPLE 4

The test Example 2 was repeated, with the liquor at 120° C. The bar suffered a loss in weight of 8 $g/m^2$ day before pickling and 9.4 $g/m^2$ per day after pickling.

EXAMPLE 5

A liquor containing 200g of sodium hydroxide per kg was heated to 60° C and a bar was immersed in it. This bar was the seat of corrosion corresponding to a loss in weight of 1.2 $g/m^2$ per day before pickling and 2.4 $g/m^2$ day after pickling.

EXAMPLE 6

The test of Example 5 was repeated with a liquor at 90° C. The corrosion suffered by the bar increased to 3.4 $g/m^2$ per day before pickling and 4.2 $g/m^2$ day after pickling.

EXAMPLE 7

The test of Example 5 was repeated, with a liquor at 110° C. The loss in weight suffered by the bar increased to 7.5 $g/m^2$ day before pickling, and to 9.4 $g/m^2$ per day after pickling.

EXAMPLE 8

When immersed in a liquor containing 100g of sodium hydroxide per kg and heated to 110° C, a bar suffered, by corrosion, a loss in weight of 5.8 $g/m^2$ day, before pickling. After pickling of the bar, the weight loss had increased to 6.5 $g/m^2$ day.

SECOND SERIES OF TESTS

The Examples which follow relate to corrosion tests on bars of extra mild steel subjected to anodic protection, by applying the method according to the invention.

For each of these tests there was employed an electrochemical cell comprising a container made of polytetrafluoroethylene for the liquor, a cathode in the form of a platinum wire and an anode consisting of the bar under test. By means of a potentiostat, a fixed potential with respect to a calomel/saturated KCl reference electrode communicating with the solution by way of a bridge was impressed on the anode bar.

So as to make Examples 9–16 comparable with Examples 1–8, the tests of Examples 9–16 were carried out under the same conditions of temperature and concentration of the liquors as in the case of Examples 1–8.

EXAMPLE 9

The conditions of Example 1 were repeated, applying additionally a potential of −800 mV to the bar. At the end of the test, the loss in weight suffered by the bar was imperceptible before pickling; it had increased to 0.3 $g/m^2$ day after pickling.

EXAMPLE 10

The conditions of Example 2 were repeated, additionally subjecting the bar to a potential of −500 mV. The weight loss suffered by the bar at the end of the test was imperceptible before pickling and had increased to 0.4 $g/m^2$ day after pickling.

EXAMPLE 11

The conditions of Example 3 were repeated with a bar held at an anodic potential of −800 MV. At the end of the test, the corrosion suffered by the bar was limited to a loss in weight of 0.2 $g/m^2$ day before pickling and to 1.2 $g/m^2$ day after pickling.

EXAMPLE 12

A bar held at a potential of −800 mV and subjected to the conditions of the test of Example 4 suffered a loss in weight of 0.4 $g/m^2$ day after pickling and 2.3 $g/m^2$ day after pickling.

EXAMPLE 13

With the application of the conditions of Example 5 to a bar held at an anodic potential of −300 mV, the loss in weight suffered by the bar increased to 0.1 g/m² day before pickling and 0.7 g/m² day after pickling.

EXAMPLE 14

The conditions of Example 6 were repeated with a bar maintained at a potential of −750 mV. At the end of the test, the loss in weight of the bar was imperceptible before pickling and had risen to 0.4 g/m² day after pickling.

EXAMPLE 15

The conditions of Example 7 were repeated with a bar held at a potential of −700 mV. At the end of the test, the bar had suffered by corrosion a loss in weight corresponding to 0.5 g/m² day before pickling and to 1.1 g/m² day after pickling.

EXAMPLE 16

The conditions of Example 8 were repeated with a bar held at an anodic potential of −700 mV. At the end of the test, the loss in weight of the bar was imperceptible before pickling. After pickling, a loss in weight of 0.1 g/m² day was found.

The results of the tests that have been described are recorded in the following table. In the table, each example of the second series of tests according to the invention has been placed next to the corresponding example of the first series of comparative tests, so as to bring into prominence the advantage of the method according to the invention.

| | Alkaline Liquor Saturated with NaCl | | Bar of Mild Steel | | |
|---|---|---|---|---|---|
| | NaOH | | | Loss in Wt. (g/m² day) | |
| Ex. No. | Content (g/kg) | Temp. (° C) | Potentials (mV) | Before Pickling | After Pickling |
| 1 | 400 | 60 | — | 1.5 | 1.6 |
| 9 | 400 | 60 | −800 | 0 | 0.2 |
| 2 | 300 | 60 | — | 2.2 | 3.2 |
| 10 | 300 | 60 | −500 | 0 | 0.4 |
| 3 | 300 | 90 | — | 9.2 | 10 |
| 11 | 300 | 90 | −800 | 0.2 | 1.2 |
| 4 | 300 | 120 | — | 8 | 9.4 |
| 12 | 300 | 120 | −800 | 0.4 | 2.3 |
| 5 | 200 | 60 | — | 1.2 | 2.4 |
| 13 | 200 | 60 | −300 | 0.1 | 0.7 |
| 6 | 200 | 90 | — | 3.4 | 4.2 |

-continued

| | Alkaline Liquor Saturated with NaCl | | Bar of Mild Steel | | |
|---|---|---|---|---|---|
| | NaOH | | | Loss in Wt. (g/m² day) | |
| Ex. No. | Content (g/kg) | Temp. (° C) | Potentials (mV) | Before Pickling | After Pickling |
| 14 | 200 | 90 | −750 | 0 | 0.4 |
| 7 | 200 | 110 | — | 7.5 | 9.4 |
| 15 | 200 | 110 | −700 | 0.5 | 1.1 |
| 8 | 100 | 110 | — | 5.8 | 6.5 |
| 16 | 100 | 110 | −700 | 0 | 0.1 |

Among the examples of application of the method according to the invention there may be mentioned, for example, the handling of liquors of caustic soda or caustic potash, concentrated in respect of sodium chloride or potassium chloride, in heat-exchangers made of ordinary steel, such as, for example, heaters, evaporators and evaporator-crystallisers. The invention finds very specially an application in the handling, in apparatus of this kind, of liquors resulting from the electrolysis of sodium chloride brine in diaphragm cells.

Various modifications can clearly be made in the preceding description, given by way of non-limiting examples, without departing from the compass of the invention.

We claim:

1. A method of handling hot aqueous solutions of caustic soda or caustic potash which are concentrated with respect to sodium or potassium chloride, in metallic equipment made of ordinary mild steel, comprising: controlling the concentration of the solution so that it contains less than 500g of alkali metal hydroxide per kg, maintaining the temperature of the solution below 130° C, and maintaining the equipment at an anodic potential lying substantially between −1,000 mV and −200 mV with respect to the potential of the saturated calomel electrode.

2. The method according to claim 1 wherein said solution derives from the electrolysis of sodium or potassium chloride brine in a diaphragm cell.

3. The method according to claim 1 wherein said equipment made of mild steel comprises at least one heater for the solution.

4. The method according to claim 1 wherein said equipment made of mild steel comprises at least one evaporator for the solution.

5. The method according to claim 1 wherein said equipment made of mild steel comprises at least one evaporator-crystalliser for the solution.

* * * * *